US006483057B1

(12) United States Patent
Wu

(10) Patent No.: US 6,483,057 B1
(45) Date of Patent: Nov. 19, 2002

(54) WATERPROOF BUTTON SWITCH

(76) Inventor: Lambert Wu, No. 78-19, Chun Shan Rd., Pali Hsiang, Taipei Hsien (TW)

( * ) Notice: Subject to any disclaimer, the term of this patent is extended or adjusted under 35 U.S.C. 154(b) by 0 days.

(21) Appl. No.: 09/903,511

(22) Filed: Jul. 13, 2001

(51) Int. Cl.[7] ..... H01H 13/06
(52) U.S. Cl. ..... 200/302.2; 200/302.1; 200/341
(58) Field of Search ..... 200/302.1–302.3, 200/329, 336, 339, 341, 345

(56) References Cited

U.S. PATENT DOCUMENTS 4,031,348 A * 6/1977 Eberhardt ..... 200/302.2
4,152,564 A * 5/1979 Wirz ..... 200/302.1
4,417,113 A * 11/1983 Saito et al. ..... 200/302.2
4,698,466 A * 10/1987 Beck et al. ..... 200/302.2

* cited by examiner

*Primary Examiner*—Michael Friedhofer
(74) *Attorney, Agent, or Firm*—Rosenberg, Klein & Lee

(57) ABSTRACT

A waterproof button switch has a switch mount and a base. The switch mount has a stage and a cap arranged thereon. The base has a hole with an inner surface. The cap has relative movement with the inner surface and also has relative movement with the stage. The cap has a recess with rectangular cross-section on a circumference thereof and a leakage proof ring is embedded into the recess. The leakage proof ring has an inner semi-segment and an outer semi-segment. The inner semi-segment has rectangular cross-section for fitting into the recess. The outer semi-segment is slantingly extended from an outer surface of the inner semi-segment and has a triangular cross-section, the outer semi-segment comprises a tail having surface contact with the inner surface of the hole.

5 Claims, 7 Drawing Sheets

WATERPROOF BUTTON SWITCH

FIELD OF THE INVENTION

The present invention relates to a waterproof button switch, especially to a waterproof button switch with leakage proof ring.

BACKGROUND OF THE INVENTION

FIG. 1 shows a prior art button switch comprising a switch mount 2*a* and a base 1*a*. The switch mount 2*a* has a stage 21*a* and a cap 22*a* arranged thereon. The base 1 a has a hole 11*a* with an inner surface 12*a*. The cap 22*a* has relative movement with the inner surface 12*a* and has relative movement with a vertical groove (not shown) in the stage 21*a*. The cap 22*a* has a recess 23*a* on a circumference thereof and a leakage proof ring 3a (such as an o-ring) is embedded into the recess 23*a*. The leakage proof ring 3*a* has circular cross-section and slides along the inner surface 12*a* of the base 1*a*.

The leakage proof ring 3*a* is made of flexible material such as rubber. When droplet accidentally insets into the hole 11*a*, the droplet is accumulated atop the leakage proof ring 3*a*. The leakage proof ring 3*a* may have problem of twisting during operation of the button switch and is expanded or shrunk with temperature variation. As a result. the droplet accumulated atop the leakage proof ring 3*a* has the risk of leaking into the switch mount 2*a* and damaging a circuit board (not shown) of the switch mount 2*a*. In other word, the leakage proof ring 3*a* cannot provide tight seal for the button switch.

SUMMARY OF THE INVENTION

It is the object of the present invention to provide a waterproof button switch with leakage proof ring.

In one aspect of the present invention, the button switch has a leakage proof ring having a tail portion bent to have surface contact with an inner wall a hole receiving a cap of the button switch. The tail is bent to form an accommodation space for storing droplet accidentally flowing into the hole.

To achieve above object, the present invention provides a waterproof button switch having a switch mount and a base. The switch mount has a stage and a cap arranged thereon. The base has a hole with an inner surface. The cap as relative movement with the inner surface and also has relative movement with the stage. The cap has a recess with rectangular cross-section on a circumference thereof and a leakage proof ring is embedded into the recess. The leakage proof ring has an inner semi-segment and an outer semi-segment. The inner semi-segment has rectangular cross-section for fitting into the recess. The outer semi-segment is slantingly extended from an outer surface of the inner semi-segment and has a triangular cross-section, the outer semi-segment comprises a tail having surface contact with the inner surface of the hole.

The various objects and advantages of the present invention will be more readily understood from the following detailed description when read in conjunction with the appended drawing, in which:

BRIEF DESCRIPTION OF DRAWING

FIG. 4 shows a sectional view the button switch of the present invention;

DETAILED DESCRIPTION OF THE INVENTION

Figure 1:
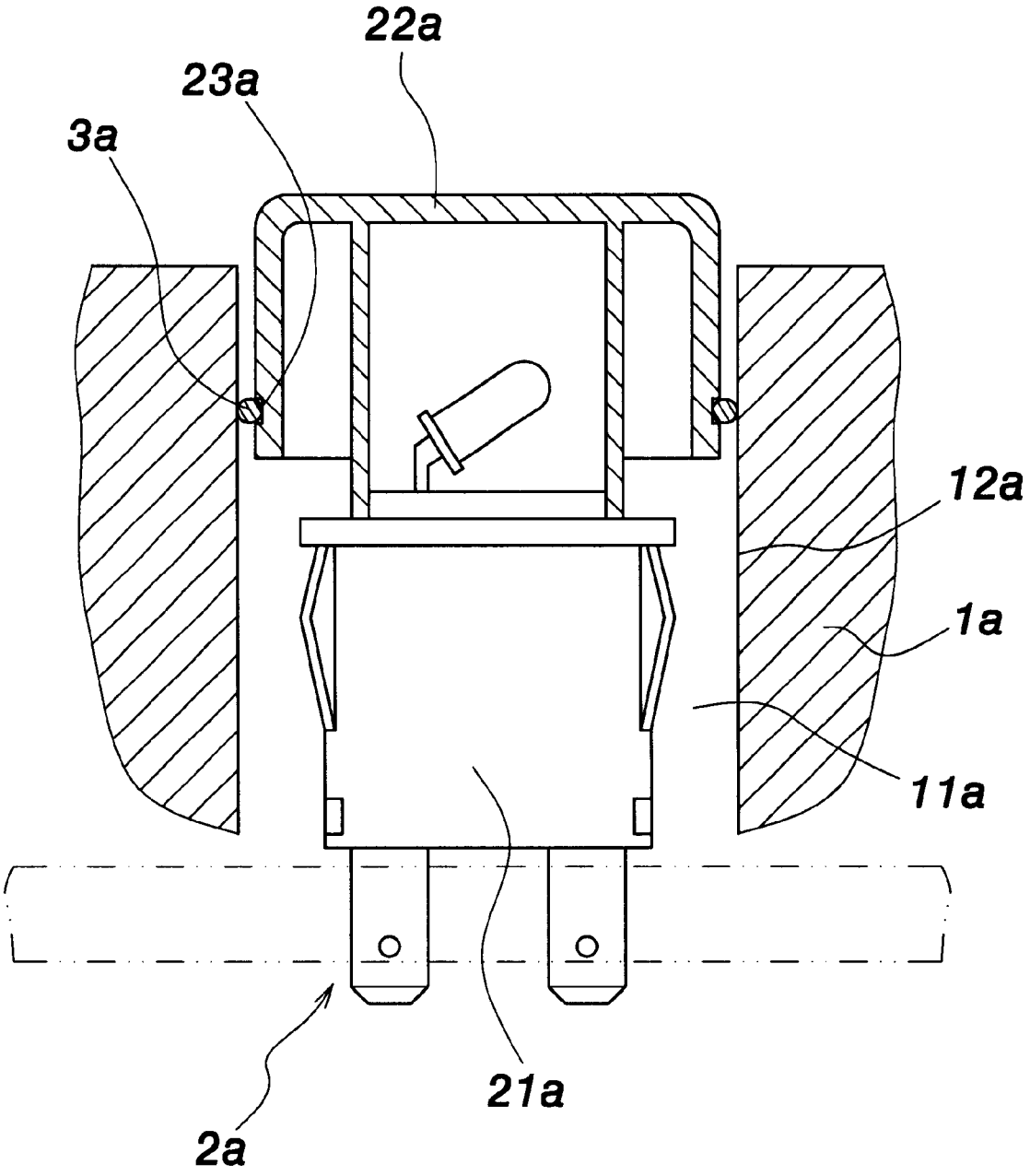
FIG. 1 PRIOR ART
FIG. 1 shows an exploded view of a prior art button switch.
Figure 2:
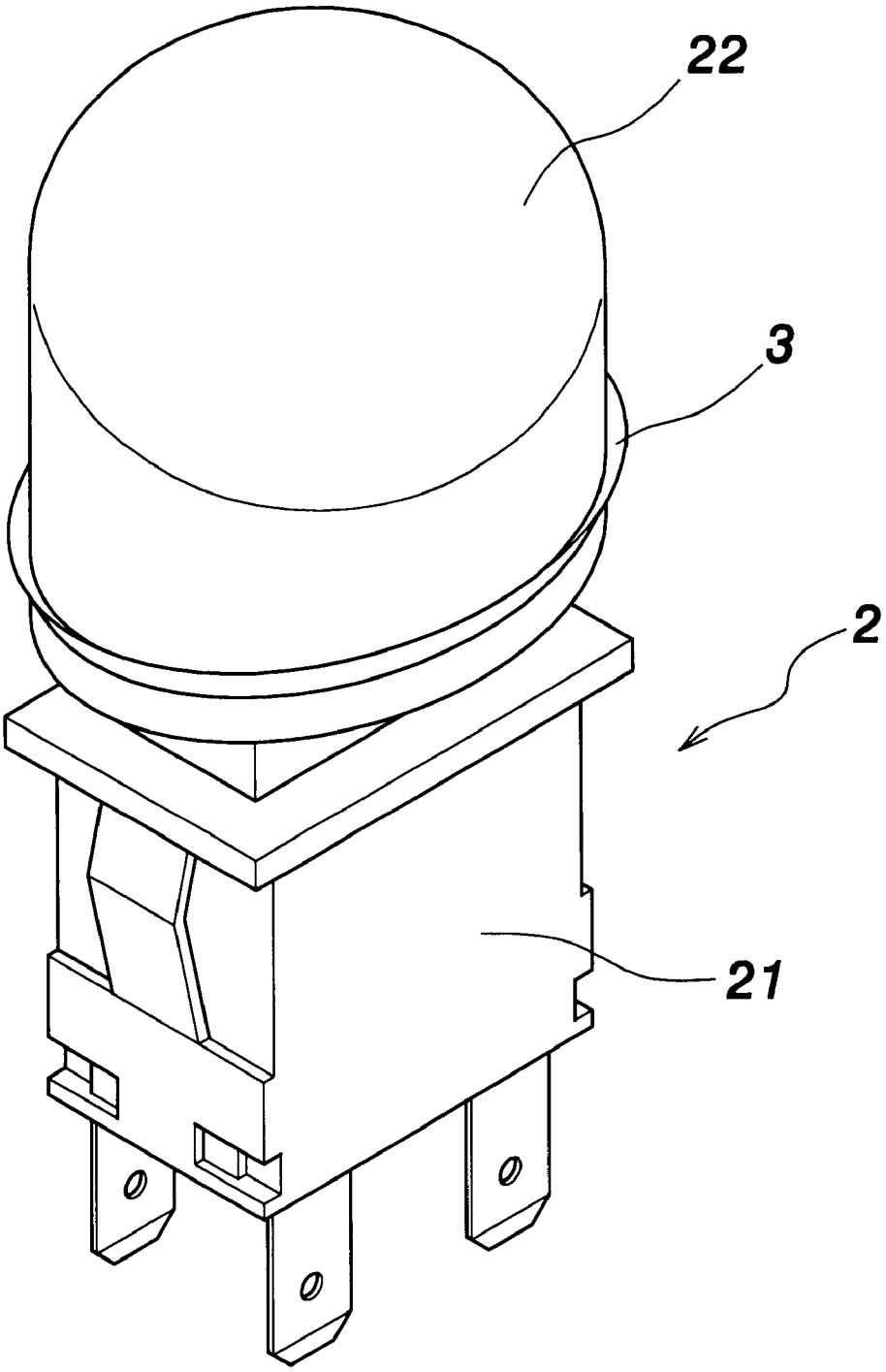
FIG. 2 shows a perspective view of the button switch of the present invention.
Figure 3:
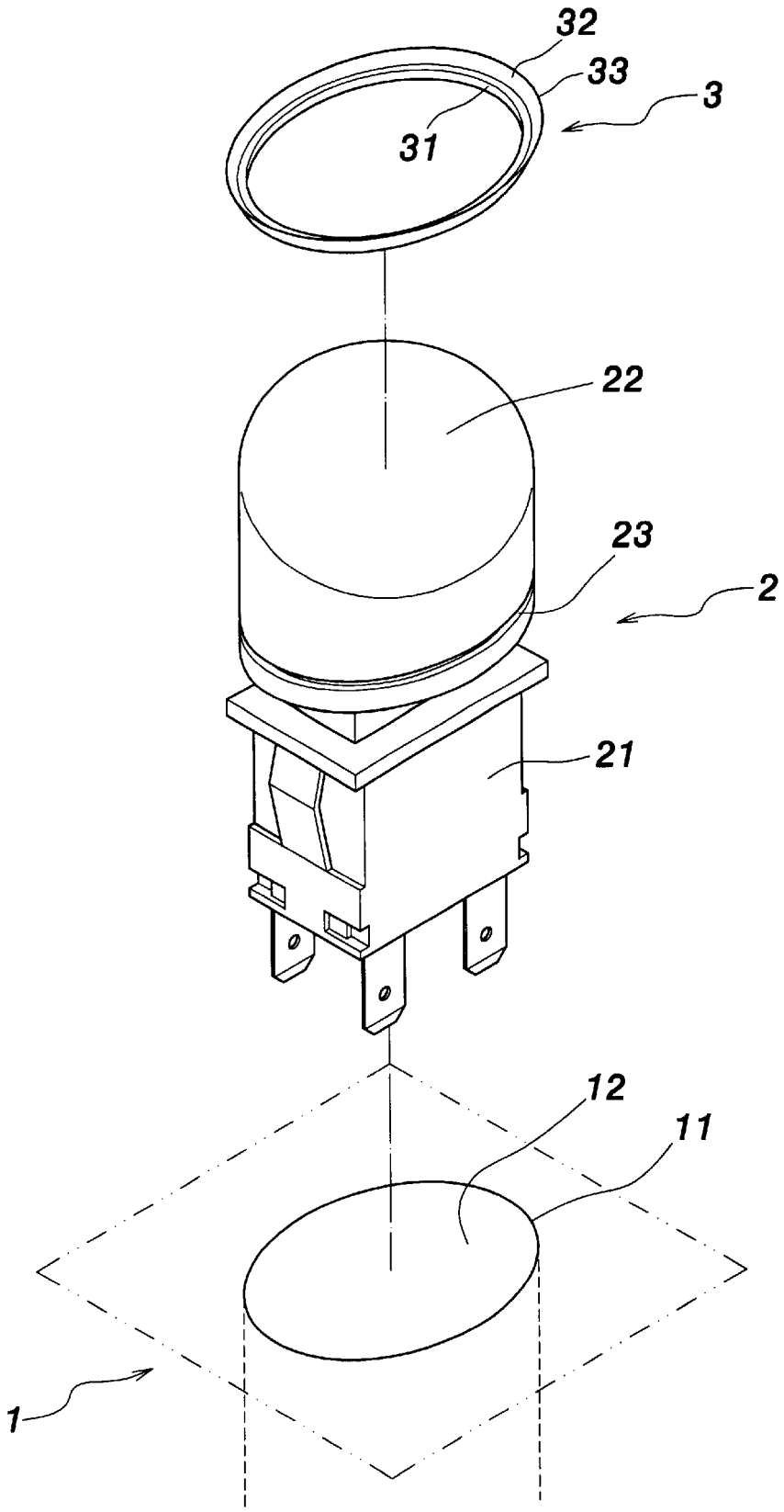
FIG. 3 shows an exploded view of the button switch of the present invention.
Figure 4:
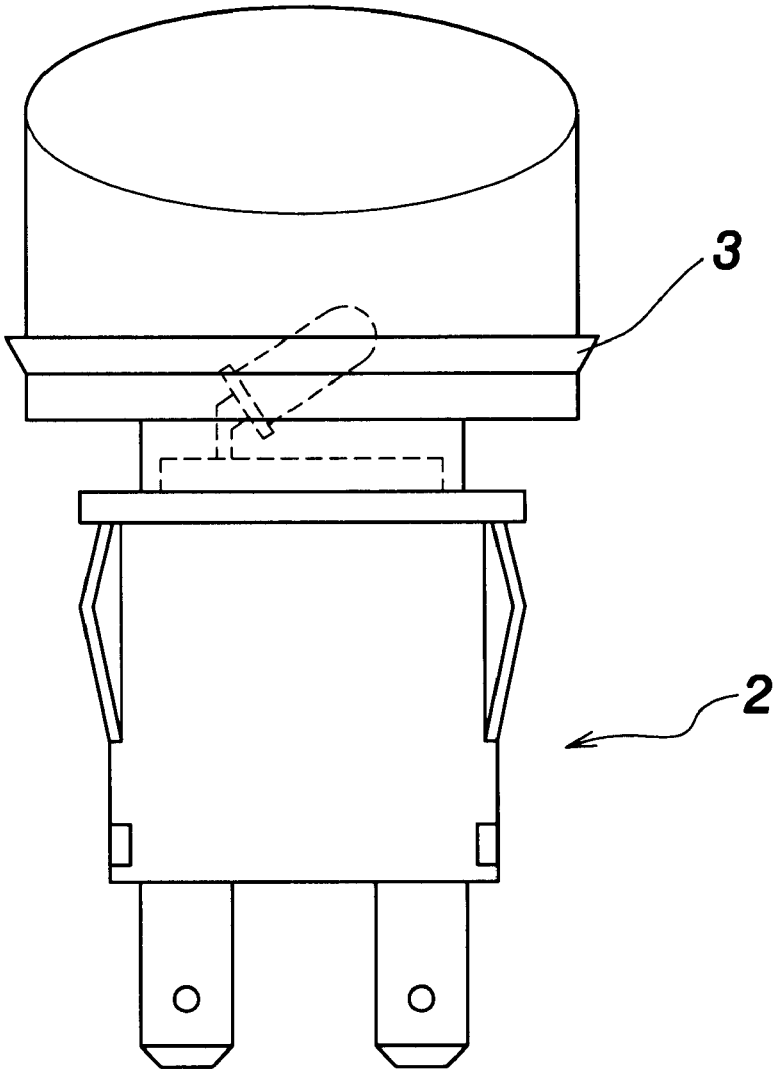
FIG. 4 shows a front view the button switch of the present invention.
Figure 5:
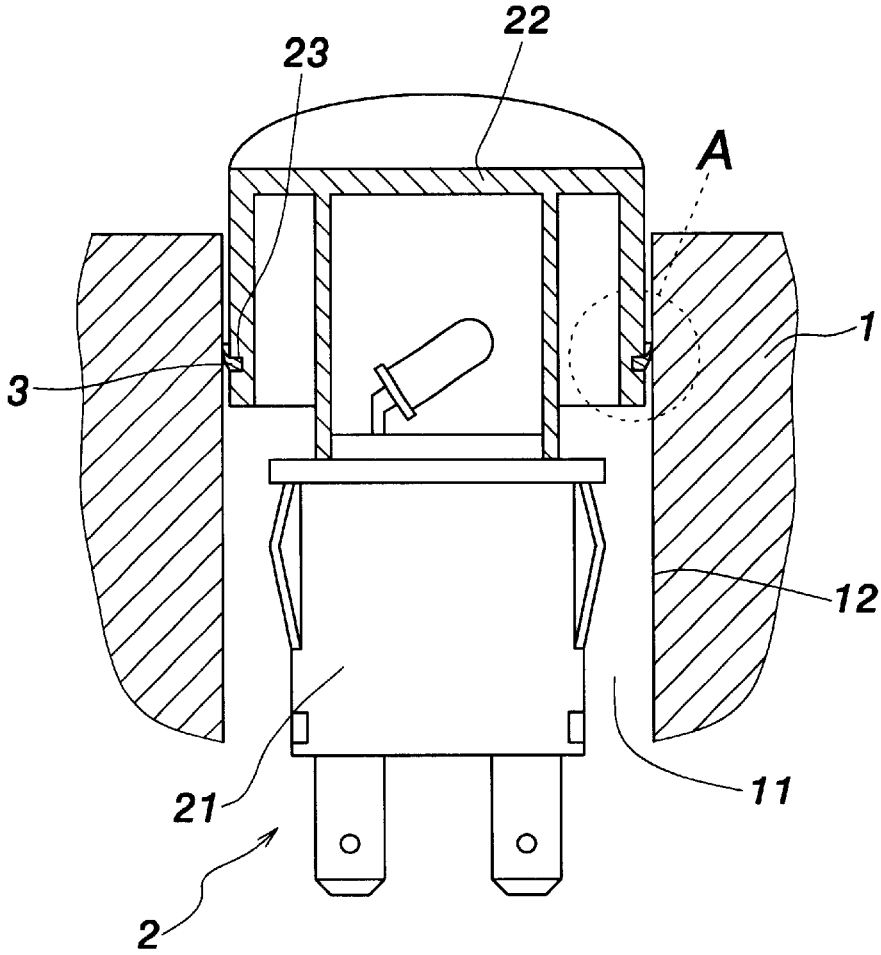

With reference now to FIGS. 2 to 9, the present invention is intended to provide a waterproof button switch having a switch mount 2 and a base 1. The switch mount 2 has a stage 21 and a cap 22 arranged thereon. The base 1 has a hole 11 with an inner surface 12. The cap 22 has relative movement with the inner surface 12 and also has relative movement with the stage 21. The cap 22 has a recess 23 with rectangular cross-section on a circumference thereof and a leakage proof ring 3 is embedded into the recess 23. The leakage proof ring 3 has an inner semi-segment 31 and an outer semi-segment 32. The inner semi-segment 31 has rectangular cross-section for fitting into the recess 23 with rectangular cross-section. The inner semi-segment 31has tight contact with the recess 23 either on a top surface thereof or on a bottom surface thereof. Therefore, the inner semi-segment 31 provides strong retaining force for the outer semi-segment 32 even though the cap 22 is moved.

The outer semi-segment 32 is slantingly extended from an outer surface of the inner semi-segment 31 and has a triangular cross-section. The outer semi-segment 32 has a larger height than that of the inner semi-segment 31 such that a tail 33 is formed. The tail 33 is bent to have surface contact with the inner surface 12. Moreover, the outer semi-segment 32 has a width larger than a gap between the inner surface 12 and the cap 22, whereby the leakage proof ring 3 provides excellent tight seal for the button switch.

Figure 6:
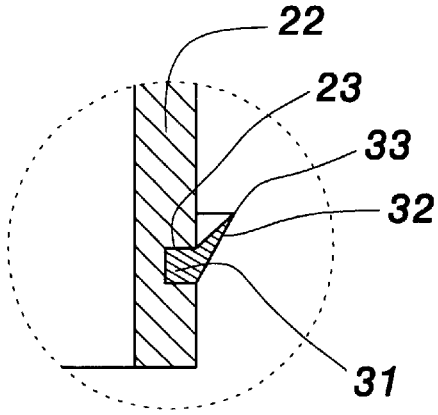
FIG. 6 shows a partially enlarged view of part A in FIG. 5.
Figure 7:
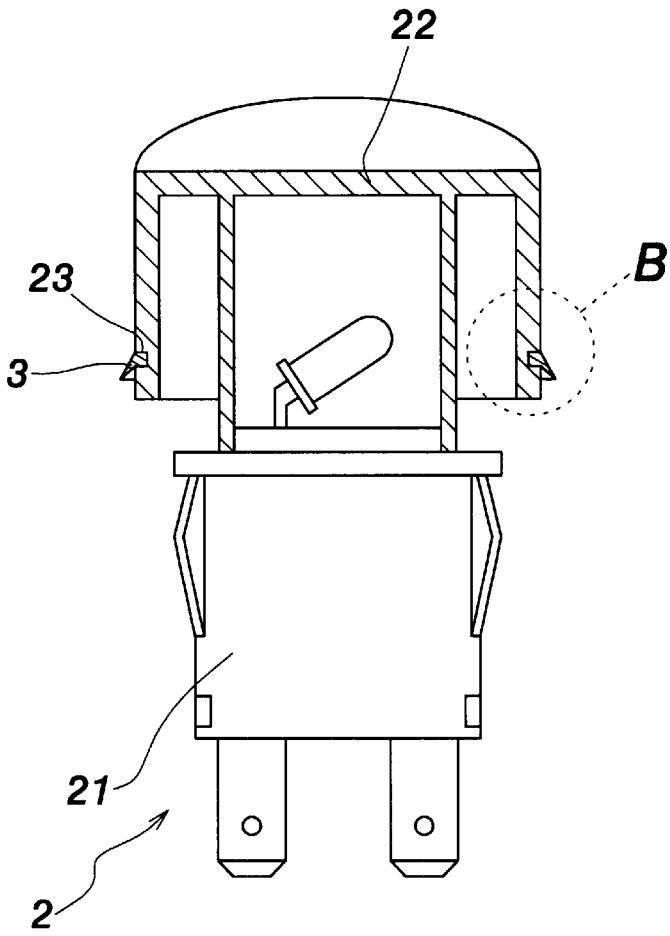
FIG. 7 shows a sectional view the button switch of another preferred embodiment of the present invention.
Figure 8:
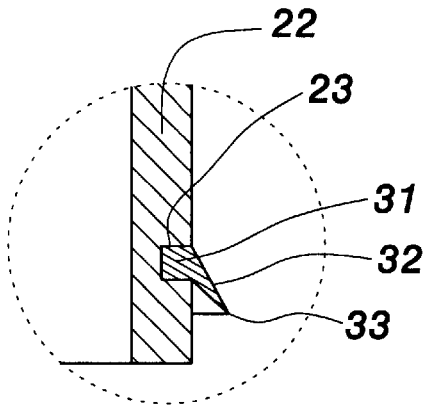
FIG. 8 shows a partially enlarged view of part B in FIG. 7.
Figure 9:
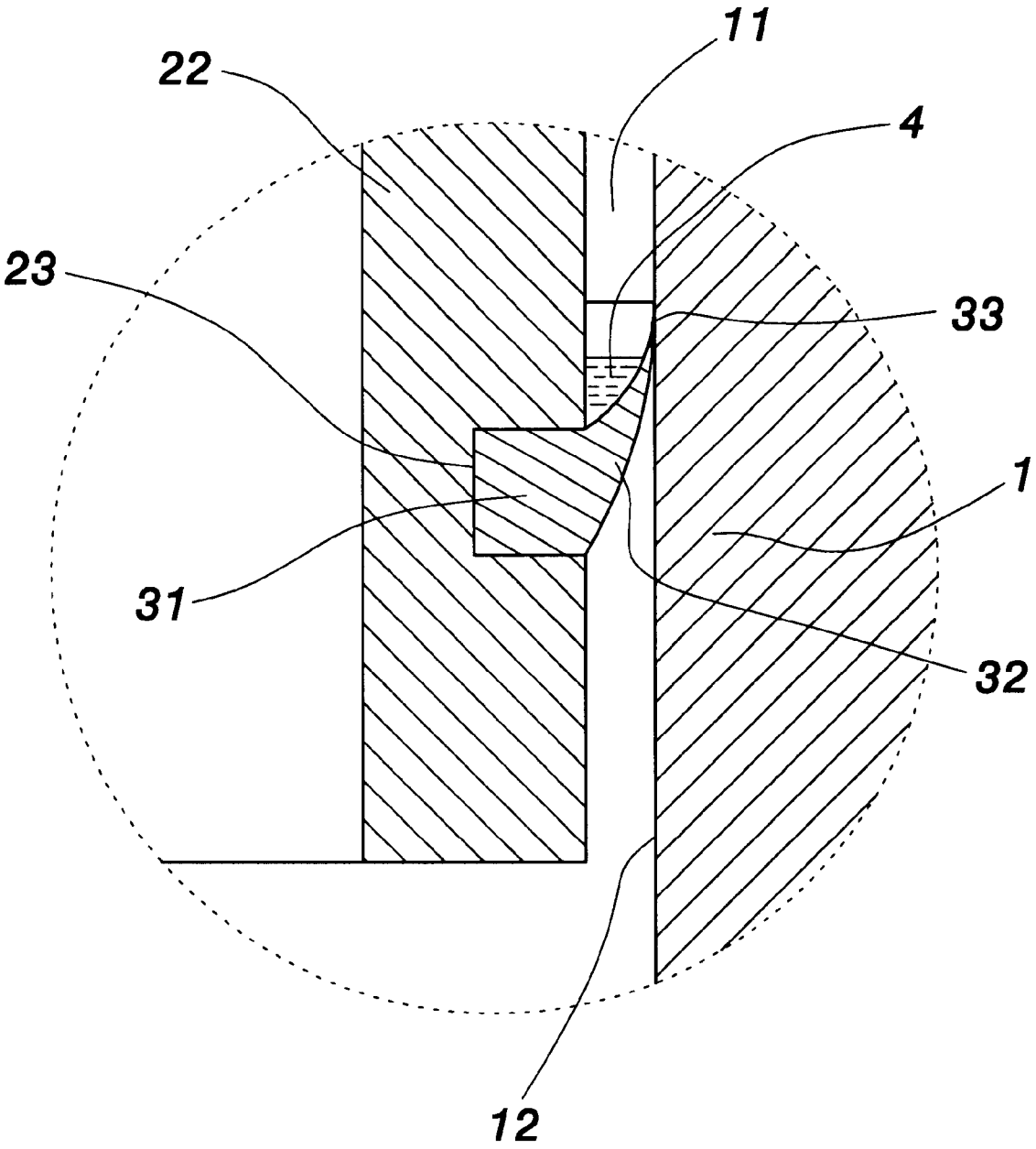
FIG. 9 demonstrates the application of the present invention.

FIGS. 6 to 8 show partially enlarged view of the invention. In FIGS. 2 to 6, the tail 33 is bent and faces oppositely the base 1. In FIGS. 2 to 6, the tail 33 is bent to face the base 1. Therefore, the leakage proof ring 3 provides excellent tight seal. As shown in FIG. 9, when droplet 4 accidentally insets into the gap between the inner surface 12 and the cap 22, the droplet 4 is accumulated in an accommodation space formed by the outer semi-segment 32 and is not leaked into the switch mount 2.

To sum up, the present invention provides a leakage proof ring composed of an outer semi-segment 32 with a tail 33. The tail 33 is bent to have surface contact with the inner surface 12. The outer semi-segment 32 is firmly retained due to the tight engagement between the inner semi-segment 31 and the recess 23. The leakage proof ring 3 provides excellent tight seal for the button switch.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A waterproof button switch, having:

a base having a hole with an inner surface;

a switch mount arranged in the base and composed of a stage and a cap arranged thereon, the cap having a recess with rectangular cross-section on a circumference thereof; and a leakage proof ring embedded into the recess, the leakage proof ring composed of an inner semi-segment and an outer semi-segment, the inner semi-segment having rectangular cross-section for fitting into the recess, the outer semi-segment being slantingly extended from an outer surface of the inner semi-segment and having a triangular cross-section, the outer semi-segment comprising a portion having surface contact with the inner surface of the hole.

2. The waterproof button switch as in claim 1, wherein the outer semi-segment has a larger height than that of the inner semi-segment.

3. The waterproof button switch as in claim 1, wherein the outer semi-segment has a width larger than a gap between the inner surface and the cap.

4. The waterproof button switch as in claim 1, wherein the portion of the outer semi-segment faces oppositely the base.

5. The waterproof button switch as in claim 1, wherein the portion of the outer semi-segment faces the base.

* * * * *